US006121948A

United States Patent [19]

Worley, III et al.

[11] Patent Number: 6,121,948

[45] Date of Patent: Sep. 19, 2000

[54] SYSTEM AND METHOD FOR REDUCING INTER-PIXEL DISTORTION BY DYNAMIC REDEFINITION OF DISPLAY SEGMENT BOUNDARIES

[75] Inventors: William Spencer Worley, III, Half Moon Bay; Wing Hong Chow, San Jose, both of Calif.

[73] Assignee: Aurora Systems, Inc., San Jose, Calif.

[21] Appl. No.: 09/074,998

[22] Filed: May 8, 1998

[51] Int. Cl.[7] ..... G09G 3/36; G09G 5/10; G09G 5/02

[52] U.S. Cl. ..... 345/100; 345/103; 345/149; 345/152

[58] Field of Search ..... 345/84, 87, 93, 345/100, 103, 115, 116, 144, 149, 152

[56] References Cited

U.S. PATENT DOCUMENTS

| | | | |
|---|---|---|---|
| 5,278,652 | 1/1994 | Urbanus et al. | 358/160 |
| 5,339,116 | 8/1994 | Urbanus et al. | 348/716 |
| 5,436,747 | 7/1995 | Suzuki | 345/87 |
| 5,508,716 | 4/1996 | Prince et al. | 345/103 |
| 5,523,803 | 6/1996 | Urbanus et al. | 348/771 |
| 5,754,160 | 5/1998 | Shimizu et al. | 345/103 |
| 5,767,832 | 6/1998 | Koyama et al. | 345/103 |
| 5,790,092 | 8/1998 | Moriyama | 345/96 |

*Primary Examiner*—Vijay Shankar
*Attorney, Agent, or Firm*—Henneman & Saunders; Larry E. Henneman, Jr.

[57] ABSTRACT

A method for writing data to a display, wherein logical segments (groups of rows) are dynamically redefined to displace the intersegment boundaries and delocalize inter-pixel electrical fields occurring across the intersegment boundaries. One particular method includes the steps of grouping rows of a display to define the logical segments, writing data to at least one of the logical segments, writing a predefined value to each of the logical segments, regrouping the rows of the display to redefine the logical segments, and writing data to at least one of the redefined segments. Code contained in an electronically readable medium, for example a memory device, causes a display driver circuit to write data to a display in accordance with the described methods.

21 Claims, 12 Drawing Sheets

| | |
|---|---|
| Segment N: row (a) - row (b) | Segment N: row (0) - row (6) |
| Intersegment Boundary row (b) / row (c) | Intersegment Boundary row (6) / row (7) |
| Segment N+1: row (c) - row (d) | Segment N+1: row (7) - row (13) |
| First Segment Redefinition | First Segment Redefinition |
| Segment N: row (a+k) - row (b+k) | Segment N: row (1) - row (7) |
| Intersegment Boundary row (b+k) / row (c+k) | Intersegment Boundary row (7) / row (8) |
| Segment N+1: row (c+k) - row (d+k) | Segment N+1: row (8) - row (14) |
| Second Segment Redefinition | Second Segment Redefinition |
| Segment N: row (a+2k) - row (b+2k) | Segment N: row (2) - row (8) |
| Intersegment Boundary row (b+2k) / row (c+2k) | Intersegment Boundary row (8) / row (9) |
| Segment N+1: row (c+2k) - row (d+2k) | Segment N+1: row (9) - row (15) |
| ⋮ | ⋮ |
| (r)th Segment Redefinition | 10th Segment Redefinition |
| Segment N: row (a+rk) - row (b+rk) | Segment N: row (10) - row (16) |
| Intersegment Boundary row (b+rk) / row (c+rk) | Intersegment Boundary row (16) / row (17) |
| Segment N+1: row (c+rk) - row (d+rk) | Segment N+1: row (17) - row (23) |

900

FIG. 9

| | |
|---|---|
| SEGMENT 0 : No Rows | 1002(0) |
| SEGMENT 1 : Rows 0-31 | 1002(1) |
| SEGMENT 2 : Rows 32-63 | 1002(2) |
| SEGMENT 3 : Rows 64-95 | 1002(3) |
| SEGMENT 4 : Rows 96-127 | 1002(4) |
| ⋮ | 1002(5-23) |
| SEGMENT 24 : Rows 736-767 | 1002(24) |

FIG. 10

1000

| LOGICAL SEGMENT | PHYSICAL ROWS | PHYSICAL ROWS | PHYSICAL ROWS | PHYSICAL ROWS | | PHYSICAL ROWS |
|---|---|---|---|---|---|---|
| 0 | None | 0 | 0-1 | 0-2 | | None |
| 1 | 0-31 | 1-32 | 2-33 | 3-34 | | 0-31 |
| 2 | 32-63 | 33-64 | 34-65 | 35-66 | | 32-63 |
| 3 | 64-95 | 65-96 | 66-97 | 67-98 | | 64-95 |
| 4 | 96-127 | 97-128 | 98-129 | 99-130 | | 96-127 |
| 5 | 128-159 | 129-160 | 130-161 | 131-162 | | 128-159 |
| 6 | 160-191 | 161-192 | 162-193 | 163-194 | | 160-191 |
| 7 | 192-223 | 193-224 | 194-225 | 195-226 | | 192-223 |
| 8 | 224-255 | 225-256 | 226-257 | 227-258 | | 224-255 |
| 9 | 256-287 | 257-288 | 258-289 | 259-290 | | 256-287 |
| 10 | 288-319 | 289-320 | 290-321 | 291-322 | | 288-319 |
| 11 | 320-351 | 321-352 | 322-353 | 323-354 | . . . | 320-351 |
| 12 | 352-383 | 353-384 | 354-385 | 355-386 | | 352-383 |
| 13 | 384-415 | 385-416 | 386-417 | 387-418 | | 384-415 |
| 14 | 416-447 | 417-448 | 418-449 | 419-450 | | 416-447 |
| 15 | 448-479 | 449-480 | 450-481 | 451-482 | | 448-479 |
| 16 | 480-511 | 481-512 | 482-513 | 483-514 | | 480-511 |
| 17 | 512-543 | 513-544 | 514-545 | 515-546 | | 512-543 |
| 18 | 544-575 | 545-576 | 546-577 | 547-578 | | 544-575 |
| 19 | 576-607 | 577-608 | 578-609 | 579-610 | | 576-607 |
| 20 | 608-639 | 609-640 | 610-641 | 611-642 | | 608-639 |
| 21 | 640-671 | 641-672 | 642-673 | 643-674 | | 640-671 |
| 22 | 672-703 | 673-704 | 674-705 | 675-706 | | 672-703 |
| 23 | 704-735 | 705-736 | 706-737 | 707-738 | | 704-735 |
| 24 | 736-767 | 737-767 | 738-767 | 739-767 | | 736-767 |
| Time | $t_0$ Initial Segment Definition | $t_1$ First Segment Redefinition | $t_2$ Second Segment Redefinition | $t_3$ Third Segment Redefinition | | $t_{32}$ 32nd Segment Redefinition |

1200

FIG. 12

SYSTEM AND METHOD FOR REDUCING INTER-PIXEL DISTORTION BY DYNAMIC REDEFINITION OF DISPLAY SEGMENT BOUNDARIES

BACKGROUND OF THE INVENTION

1. Field of the Invention

This invention relates generally to electronic driver circuits, and more particularly to a novel system and method for reducing inter-pixel electrical fields in a flat panel display.

2. Description of the Background Art

FIG. 1 shows a single pixel cell 100 of a typical liquid crystal display. Pixel cell 100 includes a liquid crystal layer 102, contained between a transparent common electrode 104 and a pixel storage electrode 106, and a storage element 108. Storage element 108 includes complementary data input terminals 110 and 112, data output terminal 114, and a control terminal 116. Responsive to a write signal on control terminal 116, storage element 108 reads complementary data signals asserted on a pair of bit lines (B+ and B−) 118 and 120, and latches the signal on output terminal 114 and coupled pixel electrode 106.

Liquid crystal layer 102 rotates the polarization of light passing through it, the degree of rotation depending on the root-mean-square (RMS) voltage across liquid crystal layer 102. The ability to rotate the polarization is exploited to modulate the intensity of reflected light as follows. An incident light beam 122 is polarized by polarizer 124. The polarized beam then passes through liquid crystal layer 102, is reflected off of pixel electrode 106, and passes again through liquid crystal layer 102. During this double pass through liquid crystal layer 102, the beam's polarization is rotated by an amount which depends on the data signal being asserted on pixel storage electrode 106. The beam then passes through polarizer 126, which passes only that portion of the beam having a specified polarity. Thus, the intensity of the reflected beam passing through polarizer 126 depends on the amount of polarization rotation induced by liquid crystal layer 102, which in turn depends on the data signal being asserted on pixel storage electrode 106.

Storage element 108 can be either an analog storage element (e.g. capacitative) or a digital storage element (e.g., SRAM latch). In the case of a digital storage element, a common way to drive pixel storage electrode 106 is via pulse-width-modulation (PWM). In PWM, different gray scale levels are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0–15) different gray scale values possible, depending on the number of "high" pulses asserted during the frame time. The assertion of 0 high pulses corresponds to a gray scale value of 0 (RMS 0V), whereas the assertion of 15 high pulses corresponds to a gray scale value of 15 (RMS 5V). Intermediate numbers of high pulses correspond to intermediate gray scale levels.

FIG. 2 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low), the third pulse B1 (2 intervals wide) is high, and the last pulse B0 (1 interval wide) is low. This series of pulses results in an RMS voltage that is approximately $\sqrt{2/3}$ (10 of 15 intervals) of the full value (5V), or approximately 4.1 V.

FIG. 3 shows 3 pixel cells 100(*a–c*) arranged adjacent one another, as in a typical flat panel display. Problems arise in such displays, because differing signals on adjacent pixel cells can cause visible artifacts in a display image. For example, electrical field lines 302 indicate that logical high signals are being asserted on each of pixel electrodes 106(*a* and *c*). The absence of an electrical field across pixel cell 100(*b*) indicates that a logical low signal is being asserted on pixel electrode 106(*b*). Note that in addition to the electrical fields 302 across liquid crystal layers 102(*a* and *c*), transverse fields 304 exist between pixel electrodes 106(*a* and *c*), carrying a logical high signal, and pixel electrode 106(*b*), carrying a logical low signal. Transverse fields 304 affect the polarization rotation of the light passing through liquid crystal layers 102(*a–c*), and, therefore, potentially introduce visible artifacts. Whether, and to what extent, visible artifacts are produced between adjacent pixel cells depends on the time period that logically opposite signals (i.e., high and low) are asserted on adjacent pixel electrodes. Adjacent pixel cells carrying opposite signals are said to be out of phase.

The transverse electrical field problem is particularly noticeable in systems which drive a display with binary weighted pulse width modulation data. In such systems, because the least-significant-bit (LSB) time is too short to allow a driver circuit to write to all of the rows of a display, the rows of the display must be grouped in segments, and the LSBs must be written to the rows of the individual segments at different times. Examples of such schemes include writing the LSBs in or between more significant bits, offsetting the LSBs with respect to each other, and writing segments "off" to provide the additional time required to write the remaining LSBs to the display. Each of these schemes, however, substantially increases the potential for the occurrence of visible artifacts along the boundaries between adjacent display segments.

FIG. 4 is a timing diagram 400 illustrating the case where an LSB (i.e., B0) is written between two more significant bits (i.e., B5 and B4). The vertical axis 402 in timing diagram 400 corresponds to the physical positions of two adjacent segments (groups of rows) X 404 and Y 406 within a display. Segment X 404 and segment Y 406 each contain a group of display rows, and are separated by an intersegment boundary 408 disposed between a bottom row of segment X 404 and a top row of segment Y 406.

The horizontal position in diagram 400 corresponds to the progression of time. At some time prior to the time period displayed by timing diagram 400, bit B5 was written to segments X 404 and Y 406. Then, at a time $t_0$, the least significant bits (B0) of data are written to the pixels of a first row (not shown) of segment X 404, and continue to be sequentially written to subsequent rows of segment X 404 until, at a time $t_1$, each pixel of each row of segment X 404 contains bit B0 of the data intended for each respective pixel. Next, from a time $t_2$ to a time $t_3$, bit B4 is written to segment X 404, replacing bit B0, and immediately thereafter, from time $t_3$ to time $t_4$, bit B0 is written to segment Y 406, replacing bit B5. Next, from a time $t_5$ to a time $t_6$, bit B4 is written to segment Y 406, replacing bit B0.

Note that from time $t_1$ to time $t_3$, and again from time $t_3$ to time $t_5$ different bits are being asserted on the pixels of the rows on either side of intersegment boundary 408. In particular, from time $t_1$ to time $t_2$, B0 is being asserted on the last row of segment X 404 and B5 is being asserted on the first row of segment Y 406. Additionally, from time $t_3$ to time $t_5$, B4 is being asserted on the last row of segment X 404 and B0 is being asserted on the first row of segment Y 406. When the data bits being asserted on opposite sides of intersegment boundary 408 have different values (i.e., one is high and the other is low), a transverse electrical field is created across intersegment boundary 408. The transverse field is intensified when the image displayed at intersegment boundary 408 is of uniform intensity, because it is then highly probable that all of the pixels in the rows on either side of intersegment boundary 406 will be displaying the same value (i.e. all B5s will have the same value, all B4s will have the same value, and all B0s will have the same value). In such cases, the transverse field across intersegment boundary 408 causes an unacceptable visible horizontal line across the displayed image.

What is needed is a system and method for reducing the transverse electrical fields across the intersegment boundaries of displays to eliminate the visible artifacts caused thereby.

SUMMARY

The present invention reduces inter-pixel electrical fields, and the resulting visual artifacts, in flat panel displays. In certain display driving schemes, data is written to a display, having a plurality of pixels arranged in a plurality of rows, one segment (logical group of rows) at a time, resulting in inter-pixel electrical fields across the intersegment boundaries. The present invention describes a novel method for writing data to the display, wherein the segments are dynamically redefined to displace the intersegment boundaries and delocalize the inter-pixel electrical fields.

One method includes the steps of grouping the rows of the display to define logical segments and intersegment boundaries therebetween, writing data to at least one of the logical segments, writing a predefined value (e.g., an off state) to each of the logical segments not already containing the predefined value, regrouping the rows of the display to redefine the logical segments and to displace the intersegment boundaries, and writing data to at least one of the redefined segments. The redefinition of the segments results in displacing any lateral electrical fields occurring between adjacent segments due to segment arrangement, thereby reducing visual artifacts in the display image.

Optionally, the method further includes the steps of writing a second predetermined value (e.g., an on state) to each of the logical segments not already containing the second predetermined value, regrouping the rows of the display a second time to redefine the logical segments and to displace the intersegment boundaries a second time, and writing data to at least one of the redefined segments.

In a particular method, the segments are redefined after less than an entire frame of data is written to the display. In an alternate method, the segments are redefined only after an entire frame of data is written to the display.

In another particular method, each segment is defined to include the maximum number of display rows that can be written to twice within a least-significant-bit (LSB) time.

In another particular method, the intersegment boundaries are displaced by one row each time the segments are redefined. Alternatively, the intersegment boundaries are displaced by more than one row each time the segments are redefined.

The various methods of the present invention may be implemented in a display driver circuit including a programmable controller. Executable code is embodied in an electronically readable medium (e.g., a memory device). When executed by the controller, the code causes the display driver circuit to write data to the display according to a method of the present invention.

BRIEF DESCRIPTION OF THE DRAWINGS

The present invention is described with reference to the following drawings, wherein like reference numbers denote substantially similar elements:

FIG. 9 is a chart illustrating the displacement of an intersegment boundary resulting from redefining segment boundaries in accordance with the present invention;

FIG. 10 is a block diagram showing the grouping of rows to define logical segments in a display having 768 rows;

FIG. 12 is a table showing the dynamic redefinition of the segments of the display of FIG. 10.

DETAILED DESCRIPTION

The present invention overcomes the problems associated with the prior art, by dynamically redefining display segment boundaries as data is written to the display. Specifically, the present invention describes a system and method for redefining display segments such that the intersegment boundaries are periodically displaced, thus delocalizing the lateral electrical fields between display segments. In the following description, numerous specific details are set forth (e.g., numbers of display rows in a segment and numbers of segments in a display) in order to provide a thorough understanding of the invention. Those skilled in the art will recognize, however, that the invention may be practiced apart from these specific details. In other instances, well known details of display driver circuits and methods have been omitted, so as not to unnecessarily obscure the present invention. For example, those skilled in the art will recognize that various embodiments of the present invention may be practiced in programmable controller based display driver circuits. As a result, the present invention may be embodied in an electronically readable medium (e.g., a memory device) containing code for execution by such a programmable controller.

Figure 1:
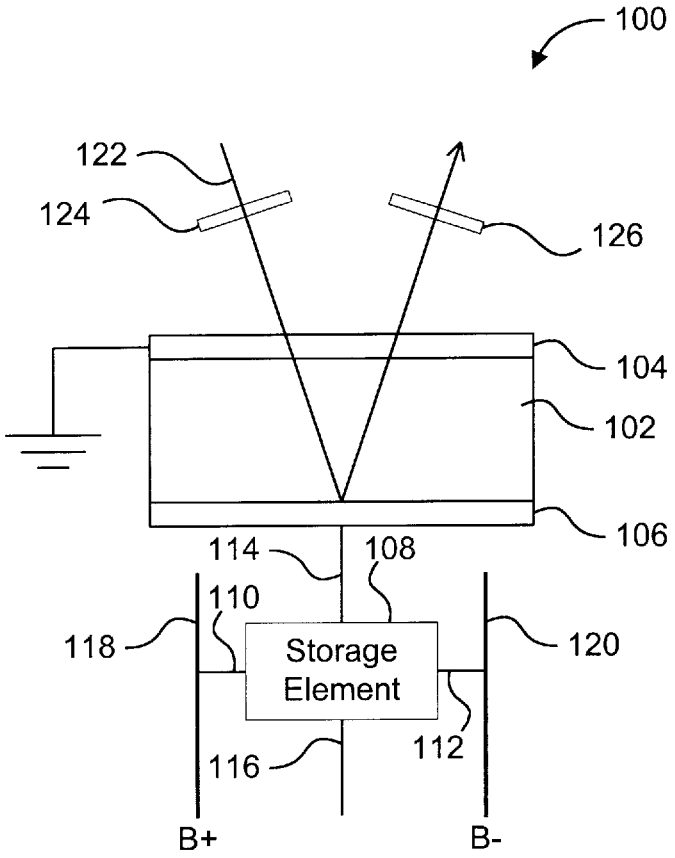
FIG. 1 Prior Art
FIG. 1 shows a single pixel cell of a liquid crystal display.
Figure 2:
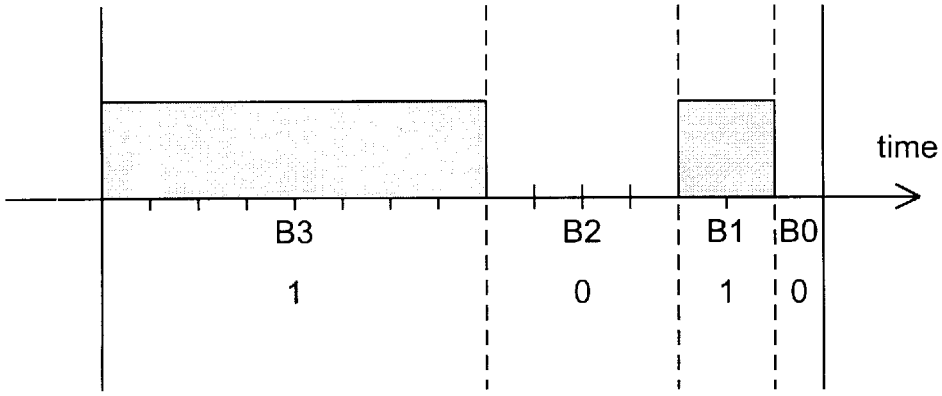
FIG. 2 Prior Art
FIG. 2 shows one frame of 4-bit, binary-weighted pulse-width modulation data.
Figure 3:
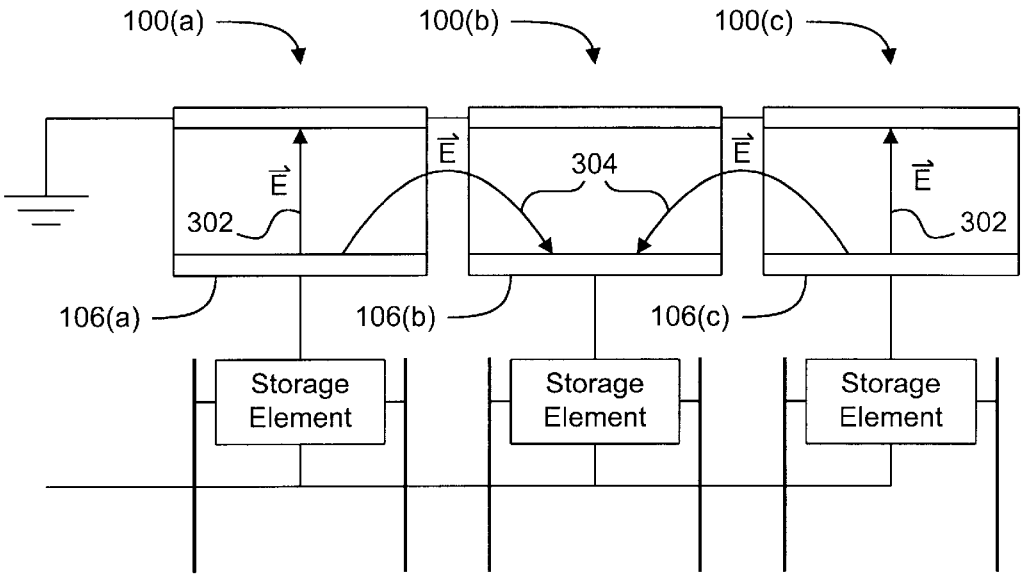
FIG. 3 Prior Art
FIG. 3 shows three adjacent pixel cells of a liquid crystal display.
Figure 4:
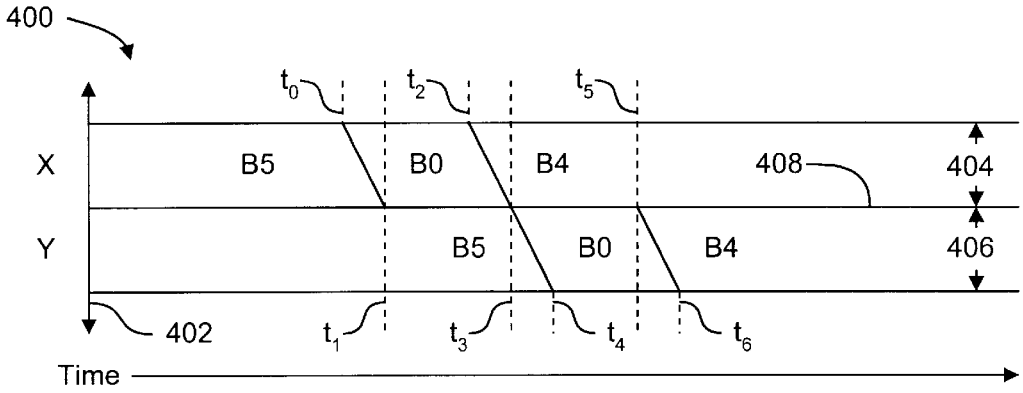
FIG. 4 Prior Art
FIG. 4 is a timing diagram showing the writing of data to two segments of a display.
Figure 5:
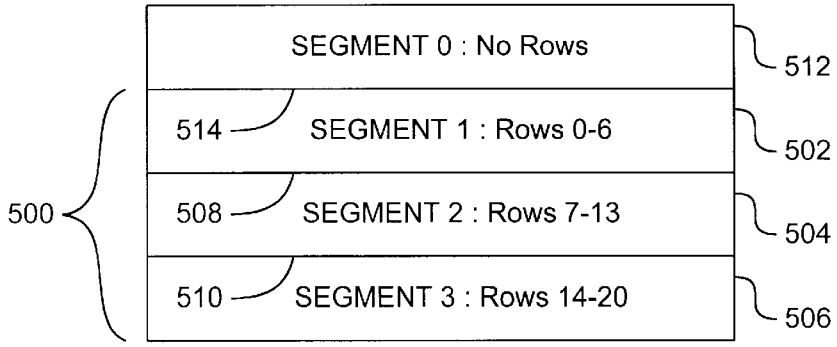
FIG. 5 is a block diagram showing the grouping of rows to define logical segments in a display having 21 rows.

FIG. 5 shows the logical grouping of rows of a display 500 to define three logical display segments 502, 504, and 506. Display 500 includes 21 rows (0–20). Segment (1) 502 is defined to include rows (0–6), segment (2) 504 is defined to include rows (7–13), and segment (3) 506 is defined to include rows (14–20). So defined, segment (1) 502 and segment (2) 504 define an intersegment boundary 508 between row (6) of segment (1) 502 and row (7) of segment (2) 504. Similarly, segment (2) 504 and segment (3) 506 define an intersegment boundary 510 between row (13) of segment (2) 504 and row (14) of segment (3) 506.

An additional logical segment (0) 512 is disposed at the top of display 500, and is initially defined to include no rows. Segment (0) 512 and segment (1) 502 define an intersegment boundary 514 therebetween, which is initially disposed at the top of display 500, just above row (0). As data is written to display 500, segment (0) 512 will be redefined, in accordance with the present invention, to include some or all of rows (0–6).

Figure 6:
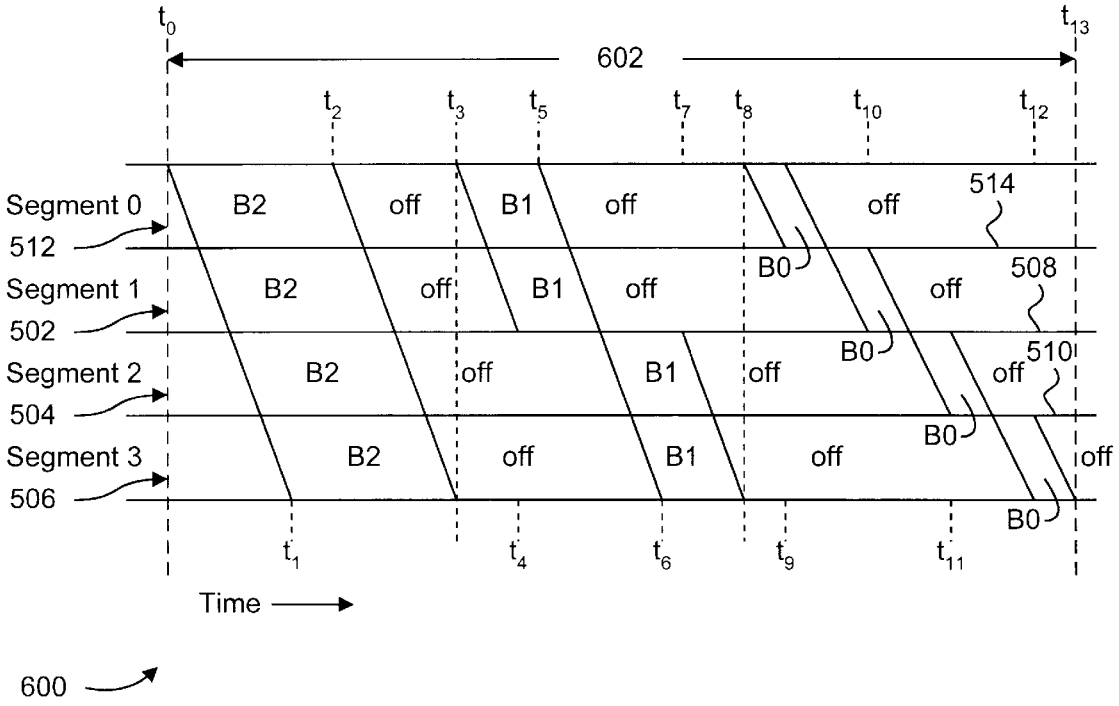
FIG. 6 is a timing diagram showing the writing of three data bits to the segments of the display of FIG. 5.

FIG. 6 shows a timing diagram 600 for writing 3 bits (B2–B0) of data to display 500 of FIG. 5. During one frame time 602 each one of bits (B2–B0) is written to each segment 502, 504, and 506 of display 500. Recall that the bit labels B2, B1, and B0 refer to the significance of the respective bit (i.e., how long the bit is to be displayed), and not the bit value. For example, the most significant bit (B2) may have a logical high value for one pixel and a logical low value for another pixel within the same segment.

Data is written to display 500 as follows. From a time $t_0$ (beginning of frame 602) to a time $t_1$, bit B2 is written to segments (0) 512, (1) 502, (2) 504, and (3) 506. Then, from a time $t_2$ to a time $t_3$, a predetermined value (e.g., an off state) is written to segments (0) 512, (1) 502, (2) 504, and (3) 506. Although it appears in FIG. 6 that it takes the same amount of time to write bit B2 to each segment, it should be understood that the actual time required to write a bit to a segment depends on the number of rows included in the segment, because data is written to a segment one row at a time. Thus, because segment (0) 512 initially contains no rows, no time is required to write a bit to that segment.

Next, from time $t_3$ to a time $t_4$, bit B1 is written to segments (0) 512 and (1) 502. Then, from a time $t_5$ to a time $t_6$, an off state is written to segments (0) 502 and (1) 504, and bit B1 is written to segments (2) 504 and (3) 506. Next, from a time $t_7$ to a time $t_8$ to a time $t_9$, an off state is written to segments (2) 504 and (3) 506. From time $t_8$ to a time $t_9$, bit B0 is written to segment (0) 512. Then, from time $t_9$ to a time $t_{10}$, an off state is written to segment (0) 512 and bit B0 is written to segment (1) 502. From time $t_{10}$ to a time $t_{11}$, an off state is written to segment (1) 502 and bit B0 is written to segment (2) 504. Next, from time $t_{11}$ to a time $t_{12}$, an off state is written to segment (2) 506 and bit B0 is written to segment (3) 505. Finally, from time $t_{12}$ to a time $t_{13}$, an off state is written to segment (3) 506 The pattern shown in timing diagram 600 for writing data and predetermined states to display 500 is repeated to write subsequent frames of data to display 500.

At various times during frame time 602, different bits are being displayed on opposite sides of intersegment boundaries 508 and 510. For example, from time $t_4$ to time $t_7$, bit B1 is contained in a segment on one side of intersegment boundary 508, and an off state is contained in the segment on the other side. Additionally, each time bit B0 is contained in one of segments (0) 512, (1) 502, (2) 504, or (3) 506, an off state is contained in the adjacent segments.

As described with respect to the prior art, the mismatch of data across intersegment boundaries 508 and 510 can cause undesirable visible artifacts in the displayed image. In this particular embodiment of the present invention, this problem is overcome by regrouping the rows of display 500, at times $t_3$ and $t_8$, to redefine segments (0) 512, (1) 502, (2) 504, and (3) 506, thus displacing intersegment boundaries 508, 510, and 512. It is important to note that the definition and redefinition of segments does not alter the destination of data (i.e., which pixel the data is written to), but only alters the order in which the data is written to the rows of display 500.

Figure 7:
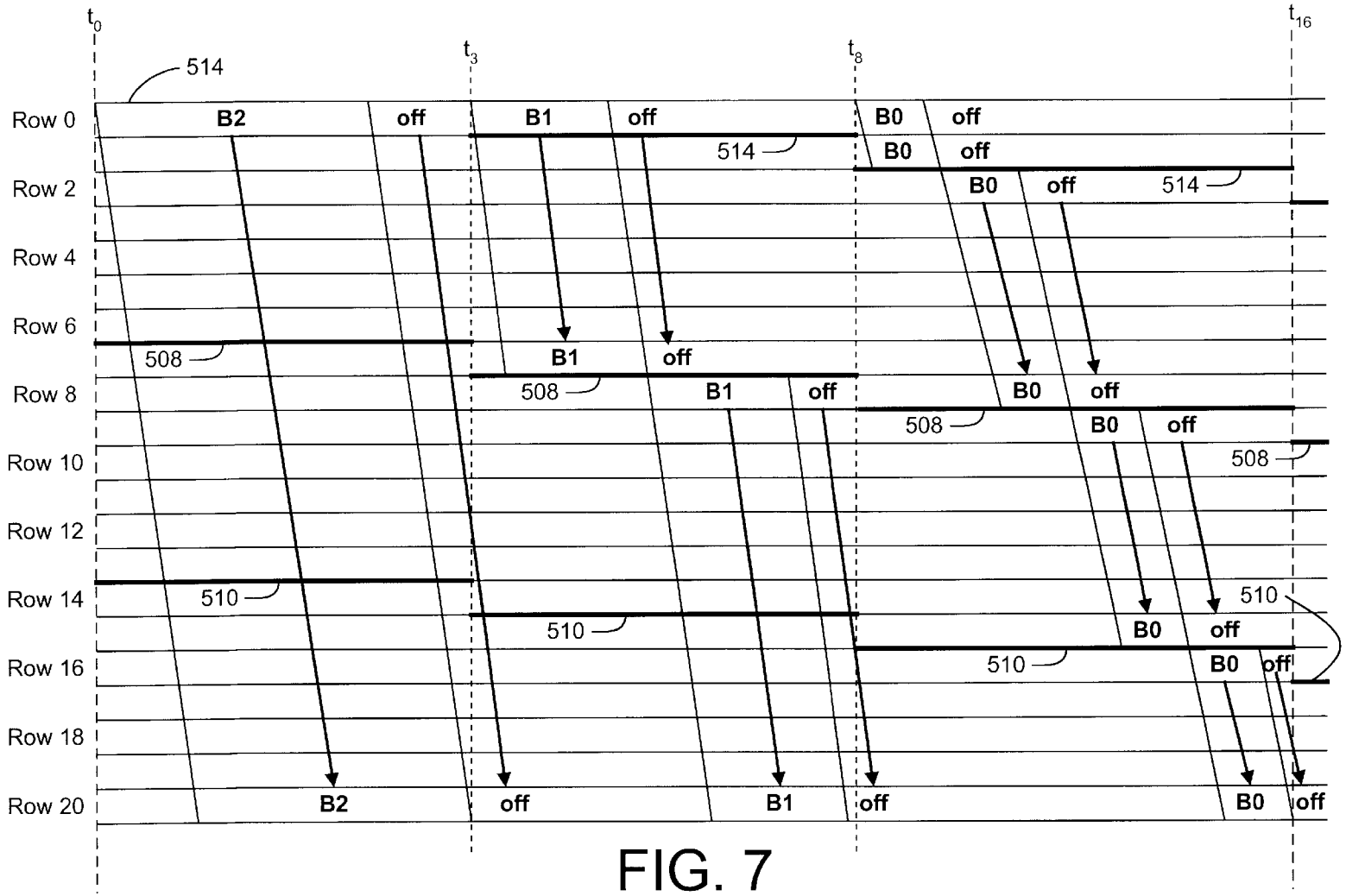
FIG. 7 is a timing diagram showing the dynamic redefinition of the segment boundaries of the display of FIG. 5.

FIG. 7 is a more detailed timing diagram of frame time 602, showing each row of display 500 individually. During the time from $t_0$ to $t_3$, segment (0) 512 is defined to include no rows, segment (1) 502 is defined to include rows (0–6), segment (2) 504 is defined to include rows (7–13), and segment (3) 506 is defined to include rows (14–20). As a result of this particular row grouping, intersegment boundary 514 is disposed at the top of display 500, intersegment boundary 508 is disposed between row (6) and row (7), and intersegment boundary 510 is disposed between row (13) and row (14).

At time $t_3$, the rows of display 500 are regrouped such that segment (0) 512 is redefined to include row (0), segment (1) 502 is redefined to include rows (1–7), segment (2) 504 is redefined to include rows (8–14), and segment (3) 506 is redefined to include rows (15–20). As a result of the segment redefinition, intersegment boundaries, 512, 508 and 510 are displaced by one row, and are disposed between rows (0) and (1), rows (7) and (8), and rows (14) and (15), respectively.

At time $t_8$, the rows of display 500 are regrouped again such that segment (0) 512 is redefined to include rows (0–1), segment (1) 502 is redefined to include rows (2–8), segment (2) 504 is redefined to include rows (9–15), and segment (3) 506 is redefined to include rows (1620). As a result of the segment redefinition, intersegment boundaries, 512, 508 and 510 are displaced by another row, and are disposed between rows (1) and (2), rows (8) and (9), and rows (15) and (16), respectively.

The rows of display 500 are regrouped again at time $t_{16}$, again shifting intersegment boundaries 512, 508, and 510, in preparation for the next frame of data. The periodic regrouping of rows continues in subsequent frames to constantly displace intersegment boundaries 512, 508, and 510, beneficially reducing the lateral electrical fields between any two segments to a level where no visible artifacts are produced.

After a predetermined number of segment redefinitions, the segments return to their original definitions. In one embodiment, the intersegment boundaries are returned to their original positions after passing through one segment. For example, when intersegment boundary 514 is disposed between row (5) and row (6), the next segment redefinition returns intersegment boundary 514 to the top of display 500 (its original position). In an alternate embodiment, successive segment redefinitions repeatedly move the intersegment boundaries through the entire display, from top to bottom. As each intersegment boundary reaches the bottom of display 500, the next segment redefinition returns it to the top of display 500.

Figure 8A:
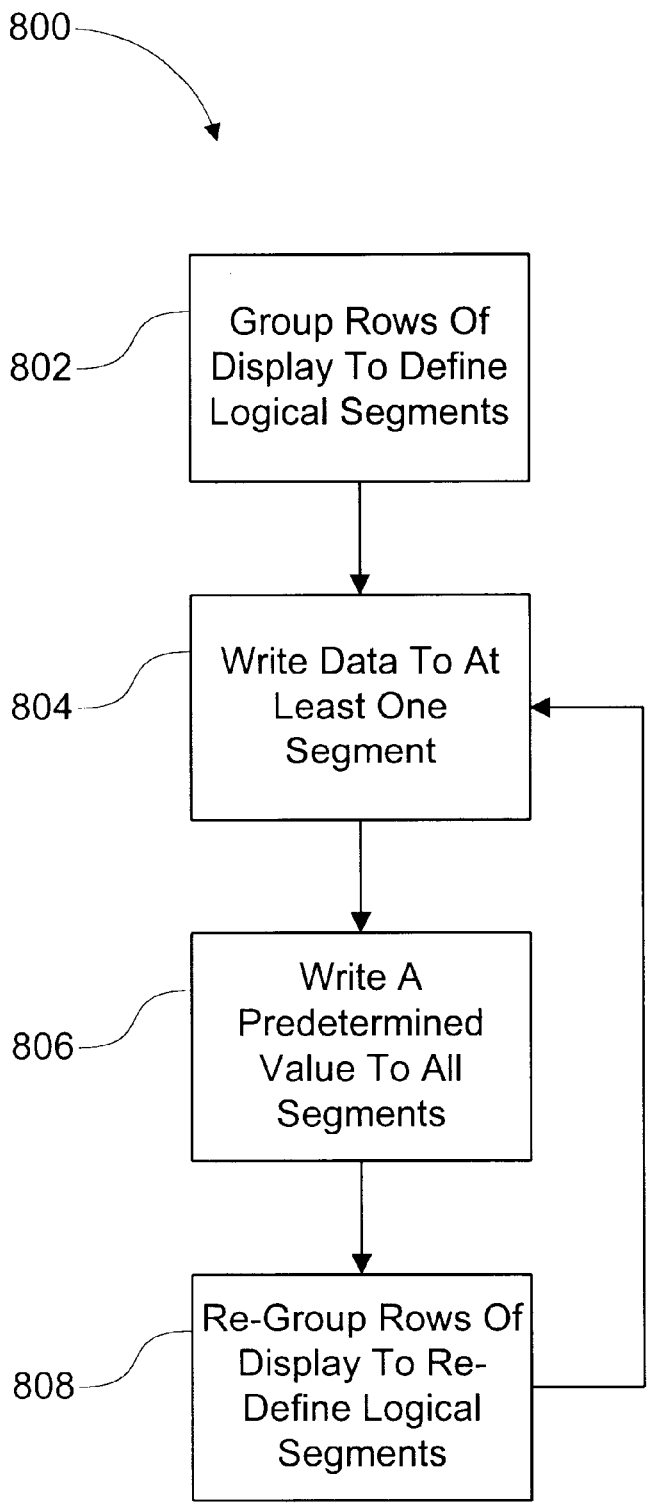
FIG. 8A is a flow chart summarizing a method for dynamically redefining segment boundaries of a display in accordance with the present invention.

FIG. 8A is a flow chart detailing one method 800 for reducing inter-pixel distortion in accordance with the present invention. In a first step 802, a display driver circuit (not shown) logically groups the rows of a display to define logical segments and intersegment boundaries therebetween. Then, in a second step 804, the display driver circuit writes data to the rows of at least one of the logical segments. Next, in a third step 806, the display driver circuit writes a predetermined value (e.g., an on state or an off state) to all segments of the display. Those skilled in the art will understand that it is not necessary to write the predetermined value to segments already containing that value. Accordingly, the display driver circuit need only write the predetermined value to segments not already containing the predetermined value. Next, in a fourth step 808, the display driver circuit logically regroups the rows of the display to redefine the logical segments and displace the intersegment boundaries, afterwhich, the method returns to the second step 804 and the display driver circuit writes the next data to at least one of the redefined segments of the display.

The predetermined values need not be written to the display solely for the purpose of redefining the logical segments. For example, in copending U.S. patent application Ser. No. 08/970,878, entitled "System and Method for Using Forced States to Improve Gray scale Performance of a Display," filed Nov. 14, 1997, by W. Spencer Worley, III and Raymond Pinkham, predetermined values (e.g., forced on and forced off states) are written to the display pixels in order to enhance the gray scale performance of the display. In such systems, the segments may be conveniently redefined each time one of the predetermined values is being asserted on each segment of the display. U.S. patent application Ser. No. 08/970,878 is incorporated herein by reference, in its entirety, as if fully set forth herein.

Figure 8B:
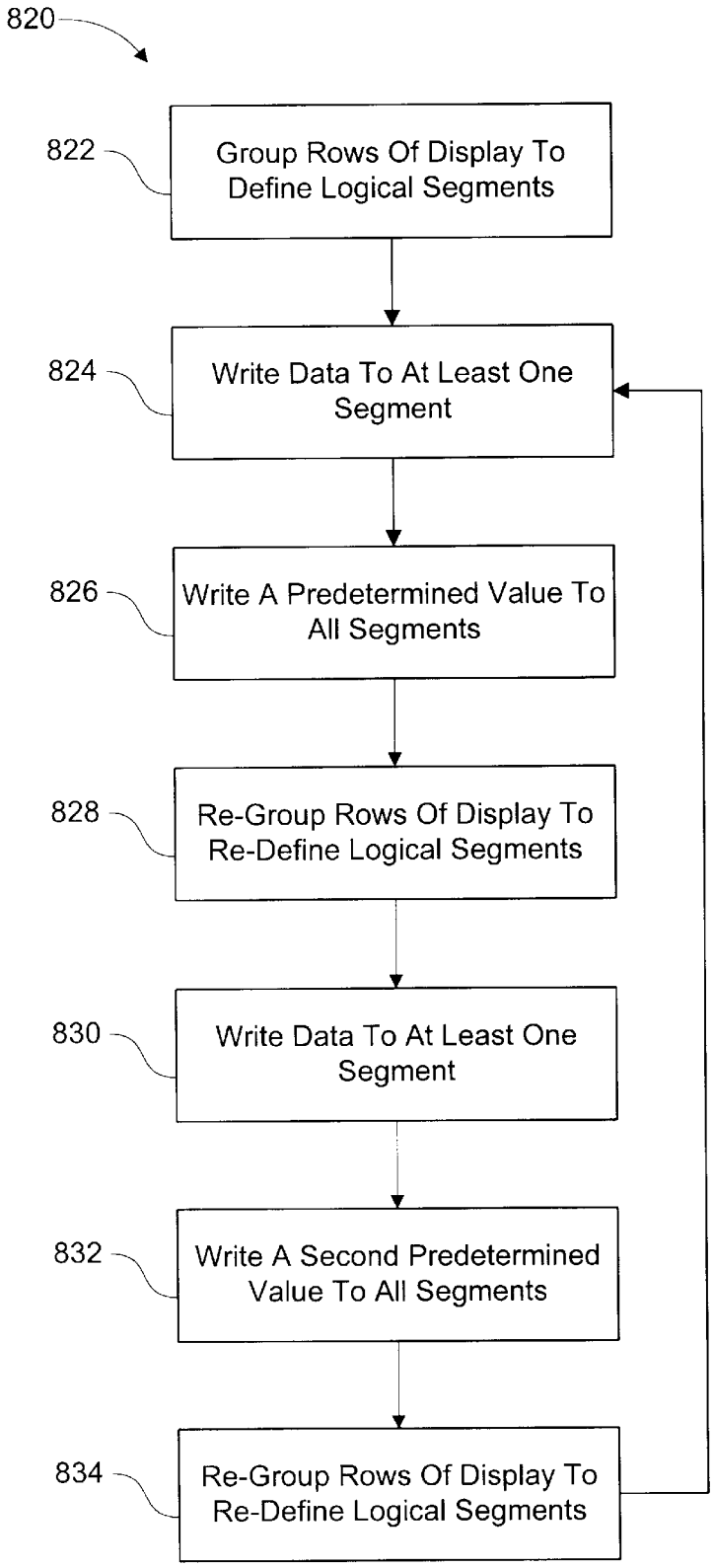
FIG. 8B is a flow chart summarizing an alternate method for dynamically redefining segment boundaries of a display in accordance with the present invention.

FIG. 8B is a flow chart detailing another method 820 for reducing inter-pixel distortion in accordance with the present invention, wherein more than one predetermined value is used. In a first step 822, a display driver circuit (not shown) logically groups the rows of a display to define logical segments, and intersegment boundaries therebetween. Then, in a second step 824, the display driver circuit writes data to at least one of the logical segments. Next, in a third step 826, the display driver circuit writes a predetermined value (e.g., an off state) to all segments of the display. Then, in a fourth step 828, the display driver circuit logically regroups the rows of the display to redefine the logical segments and displace the intersegment boundaries, afterwhich, in a fifth step 830, the display driver circuit writes the next data to at least one of the redefined segments of the display. Next, in a sixth step 822, the display driver circuit writes a second predetermined value (e.g., an on state) to all segments of the display, and then, in a seventh step 834, regroups the rows of the display to again redefine the logical segments and displace the intersegment boundaries. After redefining the logical segments in step 834, the method returns to second step 824.

Method 820 is similar to method 800, except that different predetermined values (e.g., off states and on states) are written to the display prior to each segment redefinition in alternating fashion. Those skilled in the art will understand that the particular order of using on and off states to prepare for segment redefinition is not necessary to achieve the benefits of the present invention. For example, if a particular display driving algorithm requires more off states than on states, then off states can be used more frequently than on states when redefining the display segments.

FIG. 9 is a chart 900 illustrating one particular method of redefining the logical segments of the display, as in step 808 of method 800 and steps 828 and 834 of method 820. The left and right columns of chart 900 provide, side by side, a general description and a specific example, respectively, of this particular method. At the top of the left column a first segment (N) and a second segment (N+1) are defined to include rows (a–b) and rows (c–d), respectively, such that an intersegment boundary is defined between row (b) and row (c). Proceeding down the column, after a first segment redefinition, segment (N) is defined to include rows (a+k) through (b+k), and segment (N+1) is defined to include rows (c+k) through (b+k), where k is some arbitrary number of rows. The result of the first segment redefinition is that the intersegment boundary is displaced by k rows to a position between rows (b+k) and (c+k). Then, after a second segment redefinition, the intersegment boundary is displaced by (k) additional rows to a position between rows (b+2k) and (c+2k). In general, after (r) segment redefinitions the intersegment boundary is displaced a total of (rk) rows to a position between rows (b+rk) and (c+rk).

In the specific example shown in the right column of chart 900, a=0, b=6, c=7, and d=13, such that the intersegment boundary is defined between row (6) and row (7). The value (k) is selected to be (+1), such that if the rows of the display are number in increasing order from the top of the display to the bottom of the display, each segment redefinition will advance the intersegment boundary one row down the screen. Accordingly, after the first segment redefinition, the intersegment boundary is disposed between rows (7) and (8). After the second segment redefinition, the intersegment boundary is disposed between rows (8) and (9). Eventually, after, for example, 10 segment redefinitions, the intersegment boundary is disposed between rows (16) and (17).

Those skilled in the art will understand that after a predetermined number of segment redefinitions, the segment definitions may be reset to their original definitions, thus returning the intersegment boundary to its original position. For example, if the segments of the display in the above example each contain 10 rows, then the tenth segment redefinition would reinstate the original segment definitions, returning the intersegment boundary to its original position between rows (6) and (7), instead of disposing it between rows (16) and (17).

Alternatively, segment redefinition may proceed without a periodic reset of the segment definitions. Accordingly, after a predetermined number of segment redefinitions, the intersegment boundary is displaced from one edge (e.g., the bottom) of the display to another edge (e.g., the top) of the display, so as to periodically progress through the display. For example, assume the display in the above example has 70 rows. Then, after 70 segment redefinitions, the intersegment boundary will be disposed in its original position (between rows (6) and (7)). As a further example, after 80 segment redefinitions, the intersegment boundary will be disposed 10 rows below its original position, between rows (16) (i.e., 6+80–70) and (17) (i.e., 7+80–70).

The selection of the value (k=1) should not be considered to limit the scope of the invention. Any desirable (k) may be selected. For example, if (k=2), then the intersegment boundary would be displaced down the screen by two rows, each time the segments are redefined. Alternatively, if (k) is selected such that (k=−2) then the intersegment boundary would be displaced up the screen by two rows, each time the segments are redefined.

FIG. 10 shows the logical grouping of the rows of a more complex display 1000. Display 1000 has 768 rows, which is typical of current displays. The rows of display 1000 are grouped to define 25 logical segments 1002(0–24). Initially, segment 1002(0) does not include any rows. Each of the other segments 1002(1–24) includes 32 rows. Although display 1000 has many more rows than display 500, the implementation of the present invention is at least as effective.

Figure 11A:
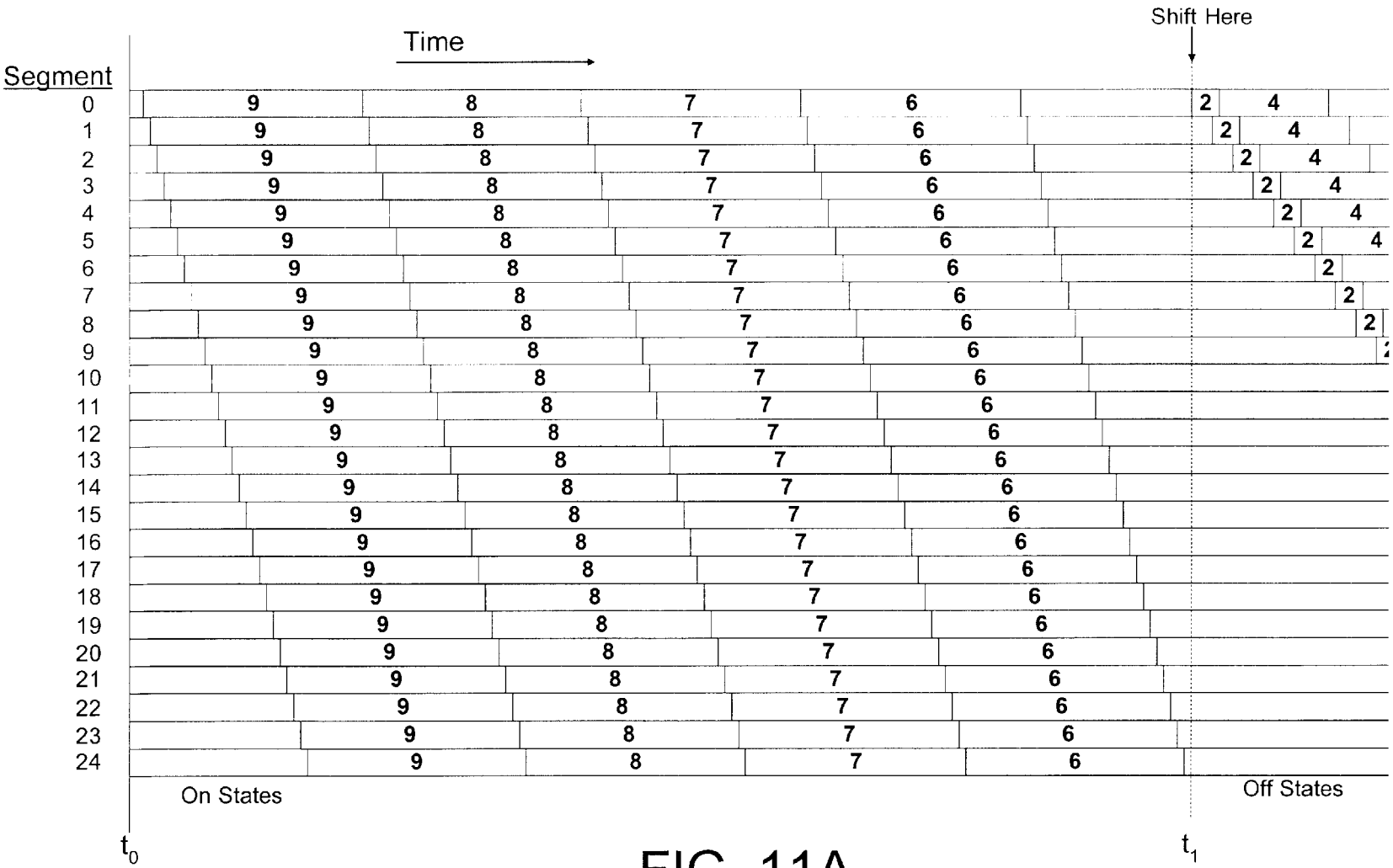
FIG. 11A shows a first portion of a timing diagram detailing the writing of ten data bits to the display of FIG. 10.
Figure 11B:
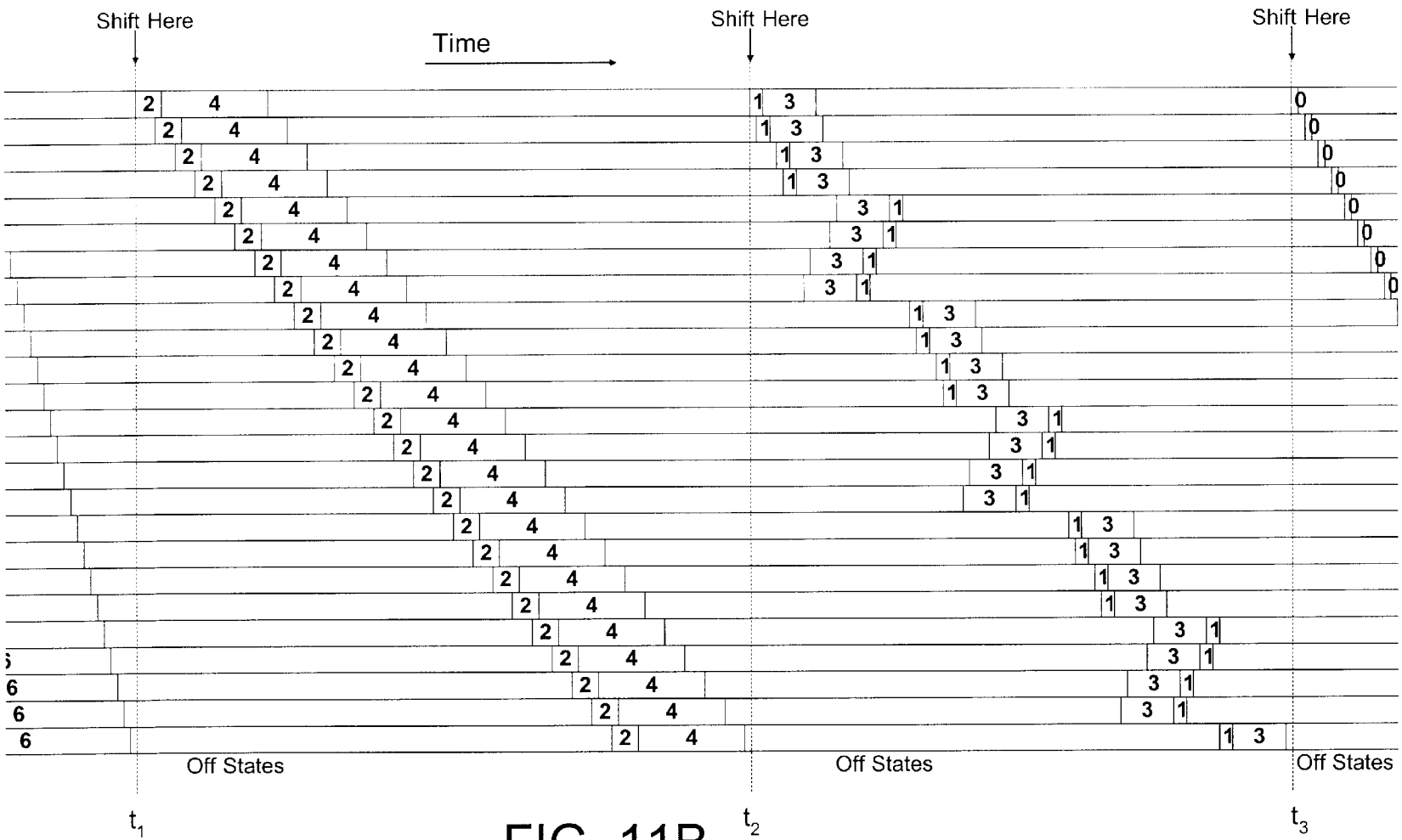
FIG. 11B shows a second portion of the timing diagram detailing the writing of ten data bits to the display of FIG. 10.
Figure 11C:
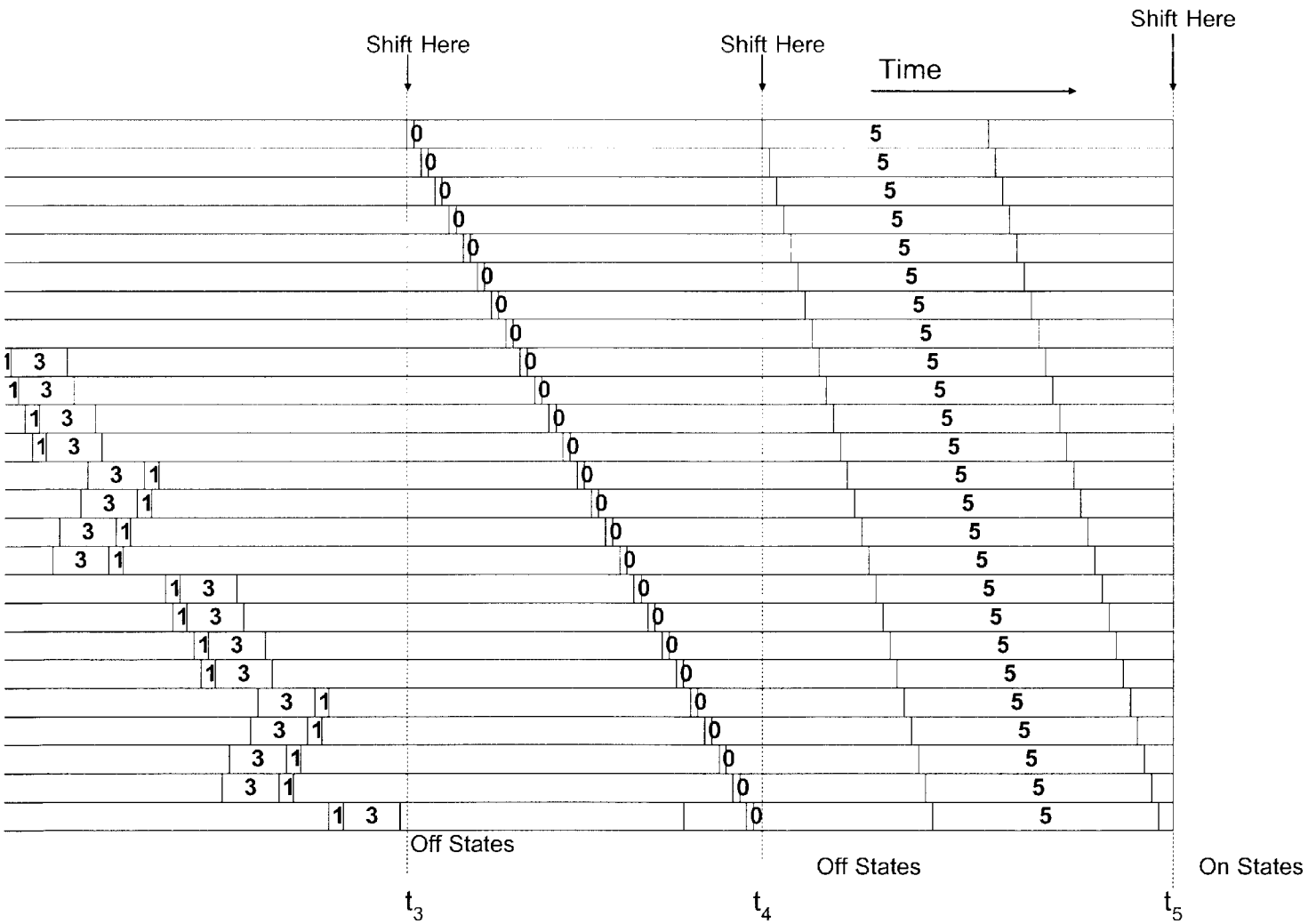
FIG. 11C shows a third portion of the timing diagram detailing the writing of ten data bits to the display of FIG. 10.

FIGS. 11A–C show a timing diagram for writing one frame of data to display 1000. Ten bits (B9–B0) of data are written to each segment of display 1000. Bits B9–B5 are equally weighted bits (i.e., asserted on the pixels for coequal time periods), and bits B4–B0 are binary weighted bits (i.e., asserted on the pixels for periods corresponding to their binary significance). This compound data scheme is described in copending U.S. patent application Ser. No. 09/032,174 (atty. docket no. 16527-0011), entitled "System And Method for Using Compound Data Words To Reduce The Data Phase Difference Between Adjacent Pixel Electrodes," which was filed Feb. 27, 1998, by W. Spencer Worley, III et al., and which is incorporated herein by reference in its entirety, as if fully set forth herein. The compound data scheme described in the incorporated copending application is also effective to reduce inter-pixel distortion, and may be implemented in conjunction with the present invention.

As shown in FIG. 11A, at the beginning of the frame, time $t_0$, on states remain on all segments (0–24) from the previous frame. During the period from time $t_0$ to time $t_1$, bits B9–B6 are sequentially written to each of segments (0–24). The significance (duration) of each of these bits allows sufficient time to write one of the bits to all of the segments before that bit must be over-written with the next bit. After bit B6 is asserted on segments (0–24) for an appropriate time, off states are written to segments (0–24). Then, at time $t_1$, the rows of display 1000 are regrouped to redefine segments (0–24).

FIG. 11B shows a next portion of the frame. During the time period from time $t_1$, to time $t_2$, bits B2 and B4 are written to redefined segments (0–24) in staggered fashion, as shown. Following the assertion of bits B2 and B4, off states are written to each of segments (0–24). Then, at time $t_2$, segments (0–24) are redefined again. Next from time $t_2$ to time $t_3$, bits B1 and B3 are written to twice redefined segments (0–24) in staggered fashion, as shown. Following the assertion of bits B1 and B3, off states are written to each of segments (0–24). Then, at time $t_3$, segments (0–24) are redefined a third time.

FIG. 11C shows the last portion of the time frame. During the time period from time $t_3$ to time $t_4$, bit B0 is sequentially written to redefined segments (0–24). Following the assertion of bit B0, off states are written to each of segments (0–24). Then, at time $t_4$, segments (0–24) are redefined again. Next from time $t_4$ to time $t_5$, bit B5 is sequentially written to redefined segments (0–24). Following the assertion of bit B5, on states are written to each of segments (0–24). Then, at time $t_5$, segments (0–24) are again redefined, in preparation for the next frame of data. The writing of data and predetermined states to display 1000, as described with reference to FIGS. 11A–C, is repeated to write successive frames of data to display 1000.

FIG. 12 is a table 1200 showing the successive redefinitions of segments (0–24) 1002(0–24) of display 1000. Note that in this particular method, the intersegment boundaries are advanced by one row from the top of the display to the bottom of the display each time segments (0–24) are redefined. Initially, segment (0) 1002(0) includes no rows and segment 24 1002(24) includes 32 rows. Each time segments 1002 (0–24) are redefined, segment (0) 1002(0) gains a row and segment (24) 1002(24) looses a row. The 32nd segment redefinition reinstates the original segment definitions, and the pattern of table 1200 is repeated as successive frames of data are written to display 1000.

The description of particular embodiments of the present invention is now complete. Many of the described features may be substituted, altered or omitted without departing from the scope of the invention. For example, the invention may be practiced in displays having a greater or lesser number of rows. Additionally, the number and timing of segment redefinitions may be altered as necessary for a particular embodiment. For example, the segments may be redefined several times within a frame, or only between successive frames. Further, the use of the present invention is not limited to liquid crystal displays. Rather, the invention may be employed wherever it is desirable to reduce the lateral electrical fields between adjacent electrodes.

We claim:

1. A method for writing data to a display, said display having a plurality of pixels arranged in a plurality of rows, said method comprising the steps of:

grouping said rows of said display to define logical segments and intersegment boundaries therebetween;

writing data to at least one of said logical segments;

writing a predetermined value to each of said logical segments not already containing said predetermined value;

regrouping said rows of said display to redefine said logical segments and to displace said intersegment boundaries; and writing data to at least one of said redefined logical segments.

2. A method for writing data to a display according to claim 1, wherein said step of grouping said rows of said display to define logical segments comprises defining said logical segments to include the maximum number of rows that can be written to twice within a least-significant-bit time.

3. A method for writing data to a display according to claim 1, wherein said step of writing data to at least one of said logical segments comprises writing less than an entire frame of data to said display.

4. A method for writing data to a display according to claim 1, wherein said step of writing said predetermined value comprises writing the same predetermined value to each of said segments.

5. A method for writing data to a display according to claim 4, wherein said predetermined value is an off state.

6. A method for writing data to a display according to claim 1, wherein said step of regrouping said rows of said display to displace said intersegment boundaries comprises regrouping said rows to displace said intersegment boundaries by one row.

7. A method for writing data to a display according to claim 1, further comprising the steps of:

writing a second predetermined value to each of said logical segments not already containing said second predetermined value;

regrouping said rows of said display a second time to redefine said logical segments and to displace said intersegment boundaries a second time; and writing data to at least one of said redefined logical segments.

8. A method for writing data to a display according to claim 7, wherein:

one of said predetermined value and said second predetermined value comprises an off state; and the other of said predetermined value and said second predetermined value comprises an on state.

9. A method for writing data to a display according to claim 7, further comprising the steps of:

subsequently writing one of said predetermined value and said second predetermined value to each of said logical segments not already containing one of said predetermined value and said second predetermined value each time a frame of data is written to said display; and subsequently regrouping said rows of said display to redefine said logical segments and to displace said intersegment boundaries, each time one of said predetermined value and said second predetermined value is contained in each of said logical segments.

10. A method for writing data to a display according to claim 7, further comprising the step of subsequently regrouping said rows of said display to redefine said logical segments and to displace said intersegment boundaries, each time one of said predetermined value and said second predetermined value is contained in each of said logical segments.

11. An electronically readable medium having code embodied therein for causing a display driver circuit to perform the steps of claim 1.

12. An electronically readable medium having code embodied therein for causing a display driver circuit to perform the steps of claim 2.

13. An electronically readable medium having code embodied therein for causing a display driver circuit to perform the steps of claim 3.

14. An electronically readable medium having code embodied therein for causing a display driver circuit to perform the steps of claim 4.

15. An electronically readable medium having code embodied therein for causing a display driver circuit to perform the steps of claim 5.

16. An electronically readable medium having code embodied therein for causing a display driver circuit to perform the steps of claim 6.

17. An electronically readable medium having code embodied therein for causing a display driver circuit to perform the steps of claim 7.

18. An electronically readable medium having code embodied therein for causing a display driver circuit to perform the steps of claim 8.

19. An electronically readable medium having code embodied therein for causing a display driver circuit to perform the steps of claim 9.

20. An electronically readable medium having code embodied therein for causing a display driver circuit to perform the steps of claim 10.

21. A method for writing data to a display, said display having a plurality of pixels arranged in a plurality of rows, said method comprising the steps of:

defining a first logical segment to include a first group of said rows;

defining a second logical segment to include a second group of said rows, one row from said first group and one row from said second group defining an intersegment boundary therebetween;

writing data to each row of at least one of said logical segments;

writing a predetermined value to each of said logical segments not already containing said predetermined value;

redefining said first logical segment and said second logical segment, such that said intersegment boundary is disposed between two rows other than said one row from said first group and said one row from said second group; and writing data to at least one of said redefined logical segments.

* * * * *